US005927634A

United States Patent [19]

Grenz et al.

[11] Patent Number: 5,927,634

[45] Date of Patent: Jul. 27, 1999

[54] COILING STEEL ROD

[75] Inventors: Günter Grenz, Meerbusch; Werner Kohlstedde, Hilden; Meinert Meyer, Erkrath, all of Germany

[73] Assignee: SMS Schloemann-Siemag AG, Dusseldorf, Germany

[21] Appl. No.: 08/979,966

[22] Filed: Nov. 26, 1997

[30] Foreign Application Priority Data

Nov. 27, 1996 [DE] Germany ..... 196 49 017

[51] Int. Cl.[6] ..... B21C 47/04

[52] U.S. Cl. ..... 242/362; 72/142; 242/908

[58] Field of Search ..... 242/360, 362.1, 242/362, 362.2, 362.3, 361.2, 361.3, 908; 72/135, 142, 143, 144, 54

[56] References Cited

U.S. PATENT DOCUMENTS

| | | | |
|---|---|---|---|
| 854,809 | 5/1907 | Daniels | 242/361.3 |
| 3,013,742 | 12/1961 | Bittman | 242/361.3 |
| 3,204,940 | 9/1965 | Morgan | 242/908 |
| 3,300,158 | 1/1967 | Strong | 242/362 |
| 3,770,025 | 11/1973 | Hirschfelder et al. | 242/361.3 |
| 3,776,519 | 12/1973 | Hamilton | 242/362 |
| 4,869,438 | 9/1989 | Braun et al. | 242/362.2 |
| 4,930,715 | 6/1990 | Grenz et al. | 242/362 |

FOREIGN PATENT DOCUMENTS 393 806 12/1991 Austria .

*Primary Examiner*—John M. Jillions
*Attorney, Agent, or Firm*—Herbert Dubno; Andrew Wilford

[57] ABSTRACT

A method of coiling steel rod arriving continuously comprises the steps of rotating about an upright axis a coiling basket defining a space centered on the axis and defined by an annular inner wall, an annular outer wall, and a floor between the walls, and feeding the rod into the space to form a coil resting on the floor and formed by a multiplicity of turns. The coil is, once formed, raised out of the space and simultaneously axially compacted and is also stabilized. More particularly the coil is stabilized by spraying an outer surface of the coil with a coolant while raising the coil out of the space. Normally the coil is rotated about the axis as the coil outer surface is being sprayed.

10 Claims, 3 Drawing Sheets

COILING STEEL ROD

FIELD OF THE INVENTION

The present invention relates to the coiling of steel rod. More particularly this invention concerns a method of and apparatus for forming compact and stable coils of steel rod.

BACKGROUND OF THE INVENTION

As steel rod exits the downstream end of a rolling line it is typically formed into annular coils each constituted by a multiplicity of turns. Such coiling is typically done in a Garrett-type installation as described in Austrian patent 393,806 by feeding the still very hot rod through a laying pipe into an upwardly open annular basket delimiting an annular space in turn defined by an inner and an outer annular array of parallel rods. The basket may be rotated to ensure that the turns lie neatly atop one another, with the coil forming from the bottom up. The entire coil-forming operation can take place under water to cool and stiffen the rod as it is coiled. Once a coil is formed of the requisite size measured along the axis, the infeed of rod is cut and the floor is raised so that an appropriate grab can carry off the finished coil.

When the rod is fairly thick, that is less than 40 mm in diameter, it can be formed into fairly stable coils that can be handled, although it takes some care to prevent the coils from spilling apart and becoming unusable. When thinner rod is wound the top several turns are normally so loose that they pose a hazard and must be cut away and discarded. Such trimming of the coil is a difficult and dangerous operation that wastes product. Even trimmed, such a coil is extremely difficult to handle. Normally there is a tradeoff between cooling the coil enough that the rod stiffens to make the coil stable, and leaving it hot enough so that for subsequent operations, e.g. forming into concrete reinforcement bar, the rod remains relatively soft so that the coil is unstable.

OBJECTS OF THE INVENTION

It is therefore an object of the present invention to provide an improved coiling system for steel rod.

Another object is the provision of such an improved coiling system for steel rod which overcomes the above-given disadvantages, that is which produces an extremely compact and stable coil.

SUMMARY OP THE INVENTION

A method of coiling steel rod arriving continuously comprises according to the invention the steps of rotating about an upright axis a coiling basket defining a space centered on the axis and defined by an annular inner wall, an annular outer wall, and a floor between the walls, and feeding the rod into the space to form a coil resting on the floor and formed by a multiplicity of turns. The coil is, once formed, raised out of the space and simultaneously axially compacted and is also stabilized according to the invention. More particularly the coil is stabilized by spraying an outer surface of the coil with a coolant while raising the coil out of the space. Normally the coil is rotated about the axis as the coil outer surface is sprayed.

The coil is axially compacted by pushing it upward out of the space by raising the floor and engaging an upper end of the coil against a stationary abutment.

Thus the apparatus according to the invention comprises a coiling basket defining a space centered on an upright axis and defined by an annular inner wall, an annular outer wall, and a floor between the walls, a drive for rotating the basket about the upright axis, and a guide for feeding the rod into the space to form a coil resting on the floor and formed by a multiplicity of turns. In accordance with the invention at least one abutment is vertically downwardly engageable with the coil and an actuator can raise the floor and push the coil up out of the space against the abutment to axially compact the coil. Nozzles are provided for spraying a coolant against an outer surface of the coil and for thereby stabilizing the compacted coil.

The abutment can be a pin radially displaceable between an inner position above the coil and an outer position offset from the coil. In fact a plurality of such pins are normally provided on the apparatus above the basket, angularly spaced about the axis.

When working with thin rod, that is less than 40 mm in diameter, the laying pipe is fitted with a thin-rod spiral tube extension having a lower end juxtaposable with the floor. In addition when working with thin rod a top ring engageable over an upper end of the space of the basket is provided with a spiral tube top mounted underneath the ring and engageable in the space.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
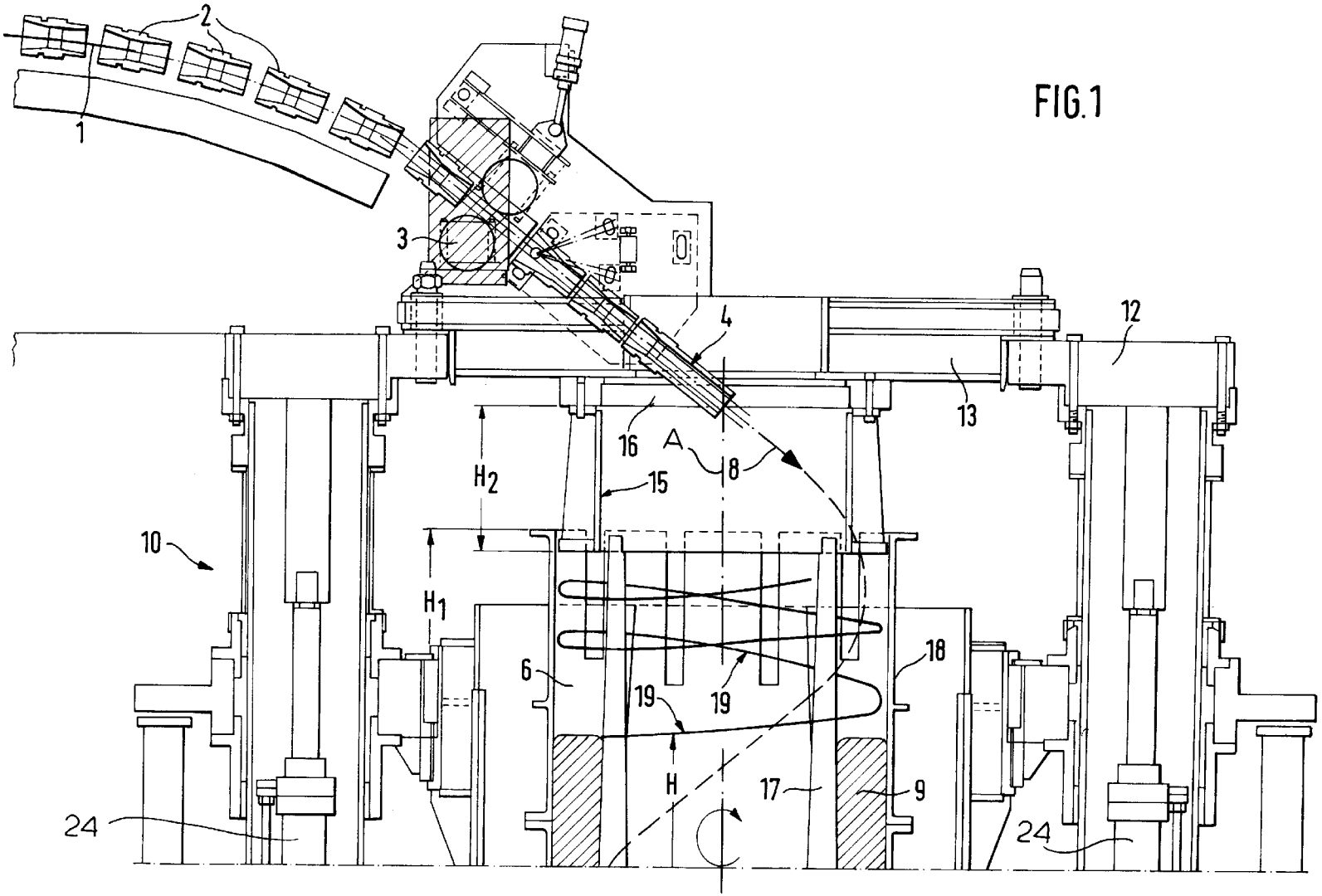
FIG. 1 is a partly diagrammatic vertical section through an upper region of a coiler according to the invention.
Figure 2:
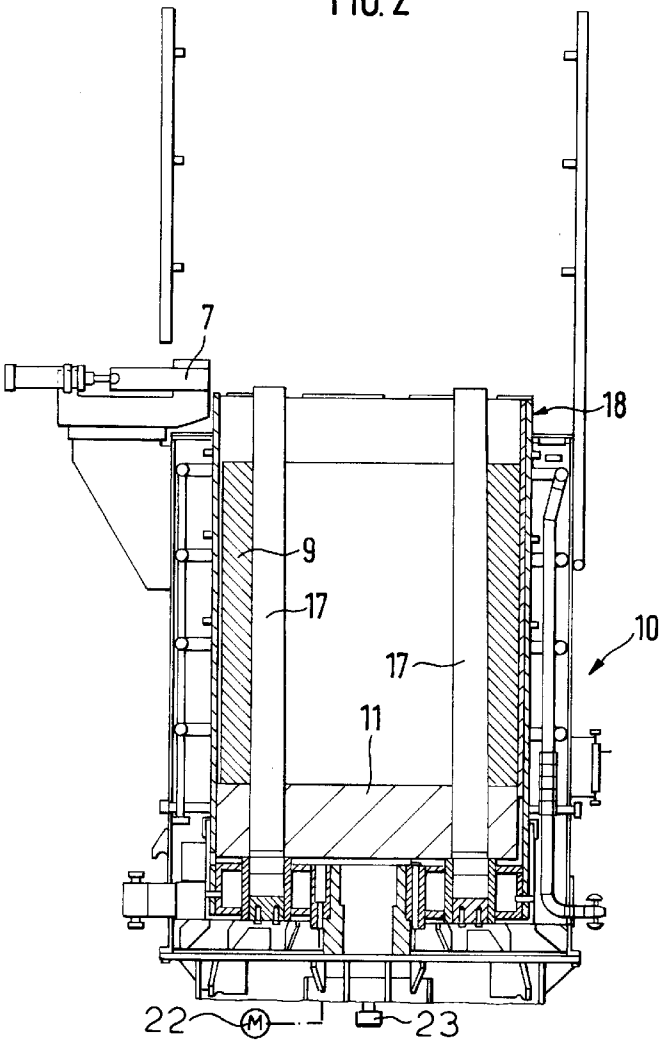

As seen in FIG. 1 a hot steel rod 1 straight from a rolling mill or the like is pulled through guides 2 by a drive 3 and fed to a laying pipe 4 directed tangentially down into a coiling basket 6 of a coiler 10. For rod that is less than 40 mm the laying pipe 4 is fitted with a vertically movable spiral extension 8 that reaches deep down into the basket 6. This basket 6 is defined by an annular array of vertical rods forming an inner wall 17, an outer wall 18, and a floor 11 that are rotatable about a center axis A by a motor 22 (FIG. 2). The floor 11 can be raised and lowered axially relative to the inner and outer walls 17 and 18 by an actuator 23 (also FIG. 2). The drive 3 and laying pipe 4 are mounted on a traverse 13 in turn removably mounted on a top ring 12 vertically displaceable by actuators 24 on the apparatus 10 so that the lower end of the pipe 4 or its thin-rod extension 8 is closely juxtaposed with the floor 11 of the basket 6. When working with thin rod a spiral tube top 15 is used mounted underneath a top ring 16 carried on the vertically displaceable traverse 13 and normally upwardly closing the basket 6.

Thus to form a coil 9 of thin rod 1 less than 40 mm in diameter the rod 1 is laid in turns 19 in the basket 6 forming a pile having a height H that increases to a height $H_1$ generally at rims of the walls 17 and 18. The spacer 15 holds the ring 16 above the basket 6 by a spacing $H_2$. The entire basket 6 rotates as the coil 9 forms. For thick rod the extension 8 and spacer 15 are not used and the traverse 13 is lowered to start with by the distance $H_2$ with the traverse 13 being raised as the coil height H increases.

According to the invention once the desired coil height $H_1$ is reached, the rod 1 is cut and the drive 3 and tube 4 are moved up out of the way with the ring 16, leaving the system in the position indicated in FIG. 2. Here angularly equispaced and radially displaceable bolts or pins 7 (only one shown) are retracted out from directly above the coil 9.

Figure 3:
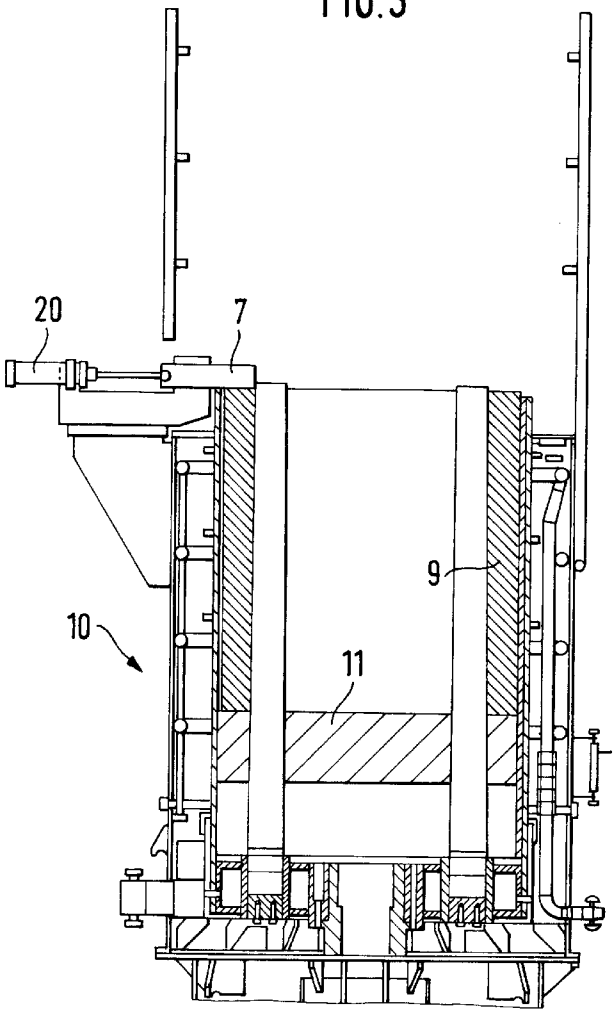
FIGS. 2 through 5 are small-scale partly diagrammatic vertical sections through the coiler in successive steps in the formation of a compact and stable coil.

Then as shown in FIG. 3 the pins 7 are all advanced to radially inner positions by respective actuators 20 and the actuator 23 raises the floor 11, pushing the still very hot coil 9 up against the pins 7 and thereby axially compressing it. At the same time the motor 22 can slowly rotate the coil 9 against its winding directions to push the individual turns down and out, forming a very compact coil. Even those uppermost loose turns that hitherto were cut off and recycled are compacted into the coil 9.

Figure 5:
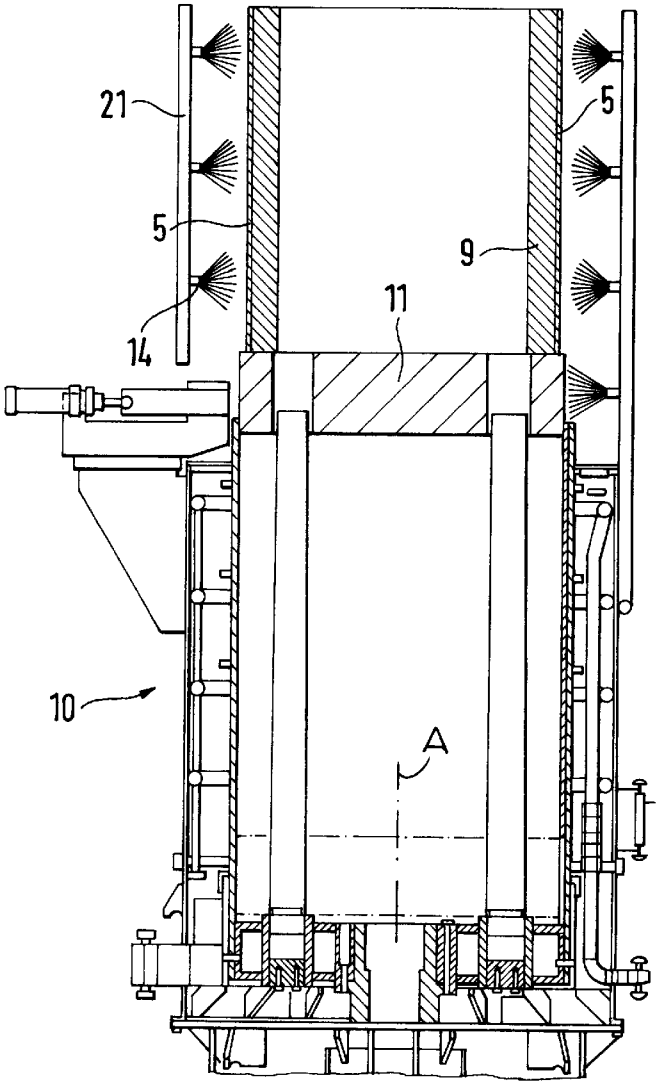
Figure 4:
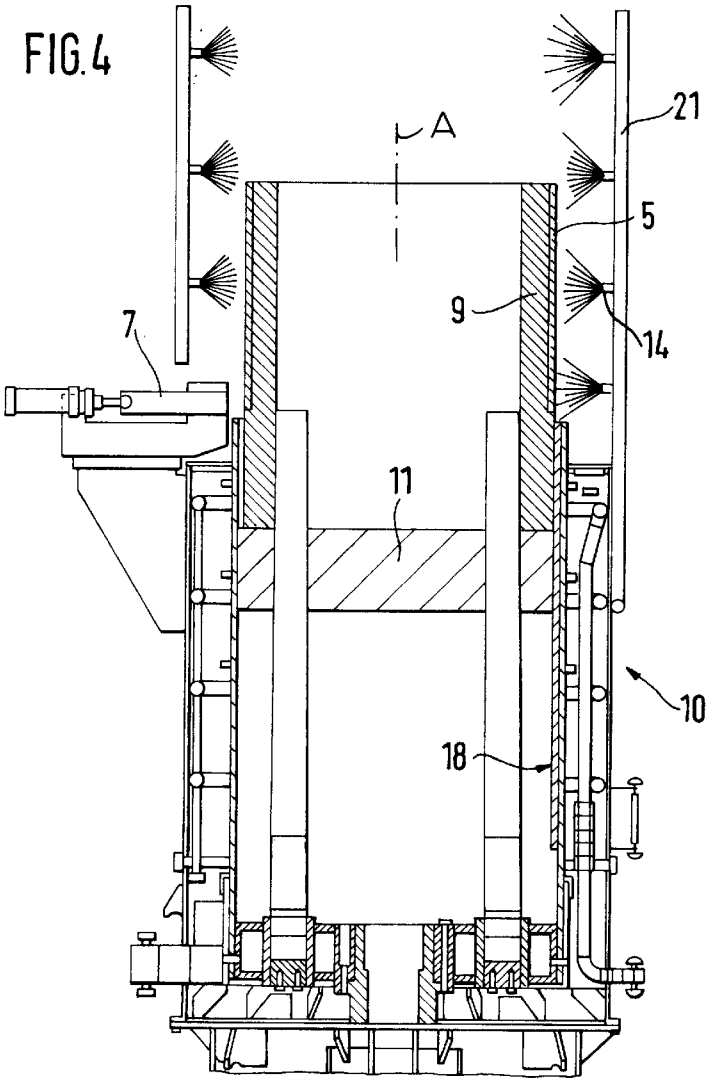

FIG. 4 shows how then the pins 7 are retracted and the compacted coil 9 is raised straight up as water sprays are directed at it from vertically and angularly spaced nozzles 14 mounted on feed manifolds 21. This chills the radial outermost turns 5 and in effect causes them to form a sort of belt or bandage that prevents collapse of the coil 9, while still leaving the inner turns fairly hot. This spraying is continued, normally while still rotating the coil 9 slowly about the axis A at least until as shown in FIG. 5 the entire coil 9 has been pushed up out of the basket 6. At this time an appropriate grab can pick up the compacted and stabilized coil 9, the floor 11 and traverse 13 can be lowered, and a new coil can be formed.

We claim:

1. A method of coiling steel rod arriving continuously, the method comprising the steps of:

rotating about an upright axis a coiling basket defining a space centered on the axis and defined by an annular inner wall, an annular outer wall, and a floor between the walls;

feeding the rod into the space from a laying pipe closely juxtaposed with the floor to form a coil resting on the floor and formed by a multiplicity of turns;

raising the coil out of the space and simultaneously axially compacting the coil; and cooling only an outer surface of the compacted coil and thereby stabilizing the compacted coil.

2. The coiling method defined in claim 1 wherein the outer surface is cooled by spraying the outer surface of the coil with a coolant while raising the coil out of the space.

3. The coiling method defined in claim 2 wherein the coil is rotated about the axis as the coil outer surface is being sprayed.

4. The coiling method defined in claim 1 wherein the coil is axially compacted by pushing it upward out of the space by raising the floor and engaging an upper end of the coil against a stationary abutment.

5. An apparatus for coiling steel rod arriving continuously, the apparatus comprising:

a coiling basket defining a space centered on an upright axis and defined by an annular inner wall, an annular outer wall, and a floor between the walls;

drive means for rotating the basket about the upright axis;

guide means including a laying pipe closely juxtaposed with the floor for feeding the rod into the space to form a coil resting on the floor and formed by a multiplicity of turns;

at least one abutment vertically downwardly engageable with the coil;

means including an actuator for raising the floor and pushing the coil up out of the space against the abutment to axially compacting the coil; and means above the basket for spraying a coolant against an outer surface of the coil and for thereby stabilizing the compacted coil.

6. The coiling apparatus defined in claim 5 wherein the abutment is a pin radially displaceable between an inner position above the coil and an outer position offset from the coil.

7. The coiling apparatus defined in claim 5 wherein a plurality of such pins are provided on the apparatus above the basket, angularly spaced about the axis.

8. The coiling apparatus defined in claim 5, further comprising a thin-rod spiral tube extension on the laying pipe having a lower end juxtaposable with the floor.

9. The coiling apparatus defined in claim 5, further comprising a top ring engageable over an upper end of the space of the basket.

10. The coiling apparatus defined in claim 9, further comprising a spiral tube top mounted underneath the ring and engageable in the space.

* * * * *